US008689889B2

(12) United States Patent
Shoyhetman et al.

(10) Patent No.: US 8,689,889 B2
(45) Date of Patent: Apr. 8, 2014

(54) DOWNHOLE MAGNET TOOL AND METHOD OF ASSEMBLY

(75) Inventors: Michael Shoyhetman, Edmonton (CA); David Budney, Sherwood Park (CA); Craig Budney, Sherwood Park (CA); Glenn Budney, Sherwood Park (CA)

(73) Assignee: Lee Oilfield Service Ltd., Edmonton (CA)

( * ) Notice: Subject to any disclaimer, the term of this patent is extended or adjusted under 35 U.S.C. 154(b) by 397 days.

(21) Appl. No.: 13/087,166

(22) Filed: Apr. 14, 2011

(65) Prior Publication Data

US 2012/0261114 A1 Oct. 18, 2012

(51) Int. Cl.
*E21B 31/06* (2006.01)
*E21B 19/16* (2006.01)

(52) U.S. Cl.
USPC ..... 166/380; 166/66.5; 166/99; 166/311; 175/328

(58) Field of Classification Search
USPC ..... 166/380, 301, 311, 66.5, 98, 99; 175/328
See application file for complete search history.

(56) References Cited

U.S. PATENT DOCUMENTS

| | | | | | |
|---|---|---|---|---|---|
| 2,092,316 | A | * | 9/1937 | Lane | 294/65.5 |
| 2,451,231 | A | * | 10/1948 | Manegold | 294/65.5 |
| 2,637,590 | A | | 5/1953 | Ortloff | |
| 2,668,077 | A | * | 2/1954 | Kirby, II | 166/66.5 |
| 2,729,494 | A | * | 1/1956 | Trowbridge | 294/65.5 |
| 2,734,767 | A | * | 2/1956 | Donham | 294/65.5 |
| 2,778,669 | A | * | 1/1957 | Goodwin | 294/65.5 |
| 2,789,790 | A | | 4/1957 | Kirby, II | |
| 2,830,663 | A | * | 4/1958 | Kirby | 166/66.5 |
| 2,830,664 | A | * | 4/1958 | Kirby, II | 166/66.5 |
| 2,833,353 | A | * | 5/1958 | Walton et al. | 166/66.5 |
| 2,834,630 | A | * | 5/1958 | Greer | 294/65.5 |
| 2,891,621 | A | * | 6/1959 | Walton et al. | 166/66.5 |
| 2,918,323 | A | * | 12/1959 | Coffee | 294/65.5 |
| 3,378,089 | A | * | 4/1968 | Marsh | 175/308 |
| 3,520,359 | A | * | 7/1970 | Ehrlich | 166/66.5 |
| 4,059,155 | A | | 11/1977 | Greer | |
| 4,226,285 | A | * | 10/1980 | Moseley, Jr. | 166/66.5 |
| 4,296,822 | A | | 10/1981 | Ormsby | |
| 5,348,086 | A | * | 9/1994 | Trout | 166/99 |
| 5,699,867 | A | * | 12/1997 | Jones | 175/296 |
| 7,219,724 | B2 | | 5/2007 | Theriot, Sr. | |
| 7,357,183 | B2 | * | 4/2008 | Gazewood | 166/301 |
| 7,753,114 | B1 | | 7/2010 | Penisson | |
| 2007/0102161 | A1 | * | 5/2007 | Gazewood | 166/301 |
| 2012/0261114 | A1 | * | 10/2012 | Shoyhetman et al. | 166/99 |

OTHER PUBLICATIONS

"Instruction Manual: Bowen Fishing Magnets," National Oilwell Varco, Houston, Tex., at least as early as Jan. 2011, 1 page.

* cited by examiner

*Primary Examiner* — Jennifer H Gay
(74) *Attorney, Agent, or Firm* — Christensen O'Connor Johnson Kindness PLLC

(57) ABSTRACT

A downhole magnet tool comprises a top sub having an inner bore terminating in a downhole facing open end, the inner bore defining a centralizer receptacle of smaller width than a width of the downhole facing open end, a mandrel terminating upwardly in a centralizer stem, the centralizer stem being fitted in the centralizer receptacle of the top sub, and a magnet mounted on a downhole facing surface of the mandrel. A method of assembly of a downhole magnet tool comprises mounting a magnet on the mandrel and inserting the centralizer stem into the centralizer receptacle.

16 Claims, 2 Drawing Sheets

DOWNHOLE MAGNET TOOL AND METHOD OF ASSEMBLY

TECHNICAL FIELD

This document relates to downhole magnet tools and methods of assembling downhole magnet tools.

BACKGROUND

Downhole magnet tools are used to remove metallic objects such as drill bit fragments, tools, tool parts, junk, and fish from a well. Examples of such tools are disclosed in U.S. Pat. Nos. 4,296,822 and 4,059,155.

SUMMARY

A downhole magnet tool is disclosed comprising: a top sub having an inner bore terminating in a downhole facing open end, the inner bore defining a centralizer receptacle of smaller width than a width of the downhole facing open end; a mandrel terminating upwardly in a centralizer stem, the centralizer stem being fitted in the centralizer receptacle of the top sub; and a magnet mounted on a downhole facing surface of the mandrel.

A method of assembly of a downhole magnet tool is also disclosed, the tool having a top sub, a mandrel, and a magnet, the top sub having an inner bore that terminates in a downhole facing open end and defines a centralizer receptacle of smaller width than the downhole facing open end, the mandrel terminating upwardly in a centralizer alignment stem, the method comprising: mounting a magnet on a downhole facing surface of the mandrel; inserting the centralizer stem through the downhole facing open end of the top sub and into the centralizer receptacle to centralize the mandrel within the top sub; and securing the mandrel to the top sub.

These and other aspects of the device and method are set out in the claims, which are incorporated here by reference.

BRIEF DESCRIPTION OF THE FIGURES

Embodiments will now be described with reference to the figures, in which like reference characters denote like elements, by way of example, and in which.

DETAILED DESCRIPTION

Immaterial modifications may be made to the embodiments described here without departing from what is covered by the claims.

During well operations such as drilling, servicing, production, or other operations, it is possible for various objects to fall into a well bore. In some cases this may occur when drilling bits or well service tools deteriorate to the point where various parts separate from the primary apparatus and fall to the bottom of the well. The metal objects, which are typically referred to in the industry as "junk" and "fish," may need to be removed from the bottom of the well before operations can continue. Junk or fish may take the form of objects as rock bit cones, tail chains, hammer heads, slips, bearings, junk mill debris and the like.

Figure 1:
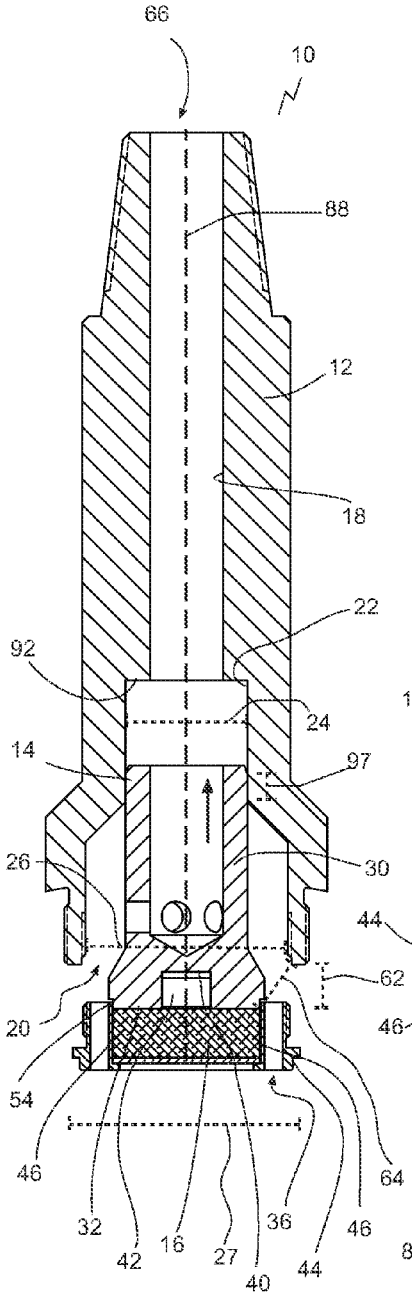
FIG. 1 is a partially exploded side elevation view of a downhole magnet tool with the mandrel partially assembled within the top sub.
Figure 2:
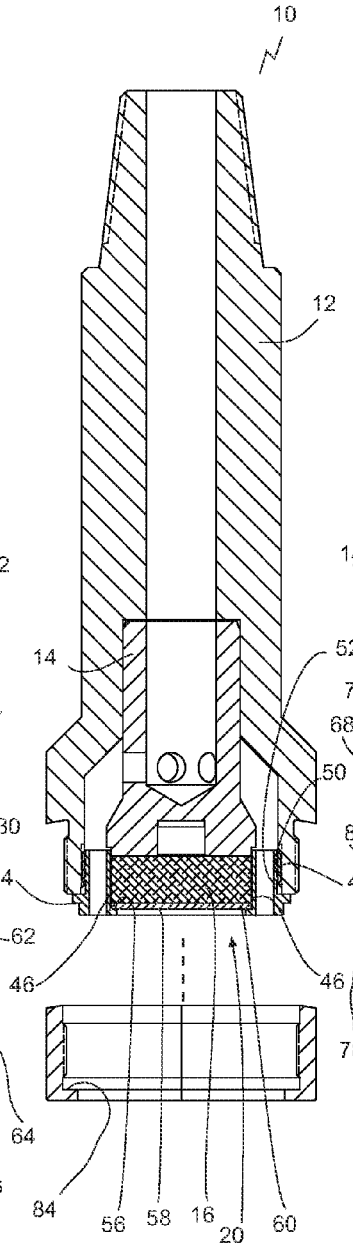
FIG. 2 is a partially exploded side elevation view of the downhole magnet tool of FIG. 1 and a flush guide for securing the mandrel within the top sub.
Figure 3:
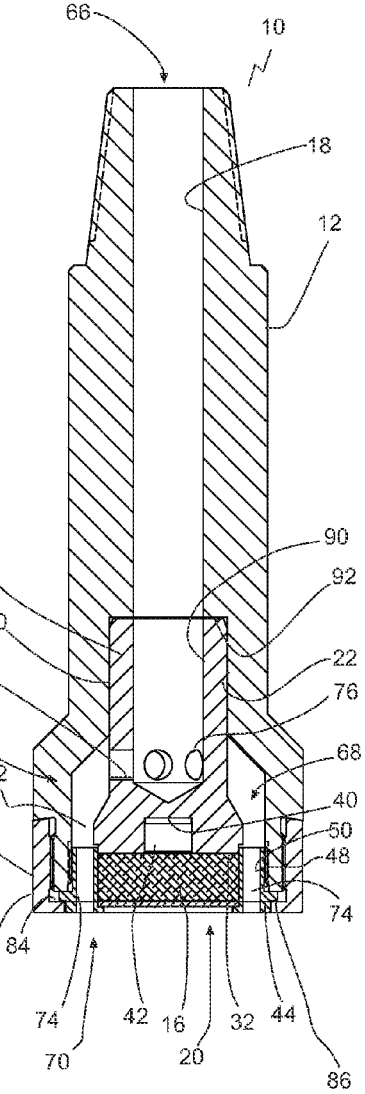
FIG. 3 is a side elevation view of the downhole magnet tool of FIG. 1 fully assembled.

Referring to FIGS. 1-3, a downhole magnet tool 10 is illustrated as having a top sub 12, a mandrel 14, and a magnet 16. FIG. 1 illustrates that the top sub 12 has an inner bore 18 that terminates in a downhole facing open end 20, the inner bore 18 defining a centralizer receptacle 22 of smaller width 24 than a width 26 of the downhole facing open end 20. Referring to FIG. 3, mandrel 14 terminates upwardly in a centralizer stem 30, the centralizer stem 30 being fitted, for example with close tolerance, in the centralizer receptacle 22 of the top sub 12. Magnet 16, such as a permanent magnet, is mounted on a downhole facing surface 32 of the mandrel 14.

The mandrel 14 may be comprised at least in part of nonmagnetic material. Nonmagnetic material is understood to include materials that are negligibly affected by magnetic fields, for example copper, aluminum, and brass. Nonmagnetic material assists in the assembly of mandrel 14 with magnet 16, because it reduces or effectively eliminates attraction between mandrel 14 and magnet 16. The mandrel 14 may include a magnet positioner, such as a pin 42, at least partially embedded in a pocket 40 in the downhole facing surface 32 of the mandrel 14, and being made at least in part of material that is attracted or attractable to the magnet 16 (FIG. 3). Examples of suitable materials for pin 42 include magnetic or paramagnetic material. Pin 42 may be at least partially embedded in downhole facing surface 32, and may assist in aligning and retaining magnet 16 within mandrel 14 while mandrel 14 is installed within top sub 12.

The mandrel 14 may further comprise a cap retainer 44, which may be in the general shape of a ring or sleeve as shown, for securing the magnet 16 within the mandrel 14. Cap retainer 44 may also secure the mandrel 14 to the top sub 12, for example, by coupling external threading 48 with corresponding internal threading 50 on the interior 52 of top sub 12 at the downhole facing open end 20 (FIG. 2). Cap retainer 44 may extend like a sleeve across the side walls 46 of magnet 16 and over a cylindrical portion 54 of mandrel 14 to laterally lock the magnet 16 to the downhole facing surface 32 (FIG. 1). Cap retainer 44 may also be secured to mandrel 14, for example, with threading (not shown), although the design shown in FIG. 1 does not have cap retainer 44 rigidly secured to mandrel 14, thus, allowing the cap retainer 44 to be rotated to secure to the top sub 12 without requiring rotation of centralizer stem 30. Once mandrel 14 has been installed in top sub 12 as shown in FIG. 2, magnet 16 is retained by an uphole facing annular shoulder 56 dimensioned to directly or indirectly abut a downhole facing surface 58 of magnet 16. Cap retainer 44 may comprise nonmagnetic material such as brass to facilitate assembly over magnet 16.

The mandrel 14 may comprise a protector plate 60 to cover downhole facing surface 58 of the magnet 16. Protector plate 60 protects downhole facing surface 58 from damage and is dimensioned to fit between downhole facing surface 58 and uphole facing annular shoulder 56 of cap retainer 44.

Magnet 16 may be a permanent magnet, such as a rare earth magnet. Permanent magnets are advantageous over electromagnets in that no external source of electricity is needed to operate the tool downhole. Rare earth magnets have been found to be useful in the downhole context and typically exhibit magnetic fields stronger than conventional permanent magnets.

The design of mandrel 14 improves the safety of the installation of the magnet 16 in the tool 10. Installation of a permanent magnet within a top sub 12 may be difficult if the top sub 12 is made of material, such as steel, that is attracted or attractable to a magnet, because of the magnitude of attractive force between magnet 16 and top sub 12 when in close proximity. This magnitude of attractive force means that the magnet 16 and top sub 12 tend to pull together, when inadvertently brought into close proximity, with forces large enough to sever fingers and break bones. In addition, once in contact with one another the magnitude of attractive force makes it difficult to separate magnet 16 and top sub 12 in order to re-attempt installation. Thus, mandrel 14 is provided with a centralizer stem 30 that corresponds with centralizer receptacle 22 to safely guide magnet 16 into tool 10. The combination of stem 30 and receptacle 22 ensure that mandrel 14 is centralized within tool 10 before the magnet 16 is brought close enough to top sub 12 to create the undesirable situations alluded to above. As shown in the sequence from FIGS. 1-2, centralizer receptacle 22 acts like a guide hole or cylinder for centralizer stem 30 to insert into and slide within like a piston or peg, allowing the mandrel 14 to axially align within the top sub 12. Thus, once axially aligned, mandrel 14, and hence magnet 16, are locked against lateral shifting towards either side of the top sub 12. As shown in the sequence, the centralizer stem 30 may be shaped to fit telescopically within the centralizer receptacle 22.

Referring to FIG. 1, tool 10 is illustrated in a partially assembled position during initial assembly of the mandrel 14 into the top sub 12. When in the partially assembled position, the centralizer stem 30 is inserted within the centralizer receptacle 22 a distance sufficient 97 to centralize the mandrel 14 within the top sub 12, while the magnet 16 is still spaced, for example a distance 62 of at least one inch, in a downhole direction from the downhole facing open end 20 of the top sub 12. The magnet 16 may also be spaced an absolute distance 64 of at least one inch from the top sub 12 when in the partially assembled position. Spacing refers to the fact that the magnet 16 and top sub 12 are sufficiently physically separated when the centralizer stem 30 aligns within the receptacle 22, such that attractive forces between the magnet 16 and top sub 12 are reduced before alignment to prevent lateral shifting during installation. Referring to FIG. 3, the magnet 16 may be ultimately positioned at least partially within the top sub 12 in use.

As shown in FIG. 1, centralizer stem 30 may extend from a base 36 of mandrel 14, that has a width 27 that is wider than width 24 of stem 30. Base 36 may secure to top sub 12 within downhole facing open end 20. The use of a stem 30 that is narrower than base 36 makes it easier to axially align stem 30 within receptacle 22 than if stem 30 were as wide, or wider than, base 36. Centralizer receptacle 22 may comprise a downhole facing seat 92 for positioning mandrel 14 within top sub 12 (FIG. 3). Seat 92 and receptacle 22 may be formed by machining an annularly-shaped cut out in inner bore 18 as shown.

Downhole magnet tool 10 may be provided for use with a suitable type of tubing string, such as coiled or jointed tubing. Adapting a tool to a coiled tubing application presents some challenges to overcome. A coiled tubing operation may involve a continuous pipe or tubing, which is uncoiled from a reel as it is lowered into the well bore, and can be used in drilling or workover applications for example. However, coiled tubing presents a number of working constraints to the design of a tool. In coiled tubing applications the overall length of the downhole tool becomes significant since there is limited distance available at the wellhead, for example, between the stuffing box and the blowout preventer, to accommodate the tool string. Thus, the length of the magnet tool 10 itself becomes particularly significant since the entire bottom hole assembly may be required to fit within the limited distance between the stuffing box and blowout preventer to introduce it into a pressurized well.

As shown in FIGS. 1-3, the magnet 16 may be disc shaped, which may allow tool 10 to be provided in a shorter overall length. The use of a disc shaped magnet can produce attractive forces comparable to a magnet of greater length but having similar composition and lateral dimensions.

In some embodiments, the tool 10 may include one or more fluid passages 68 (FIG. 3). Inner bore 18 may terminate in an uphole facing open end 66, with at least the mandrel 14 defining the one or more fluid passages 68 between the inner bore 18 and a downhole facing end 70 of the mandrel 14. The one or more fluid passages 68 may comprise an annular chamber 72 defined between the mandrel 14 and the top sub 12, for example between the centralizer receptacle 22 and the downhole facing end 70 of mandrel 14. The one or more fluid passages 68 may further comprise a series of passages communicating with annular chamber 72. For example, passages 68 may comprise one or more passages, such as lateral passage 76, from the inner bore 18, through the mandrel 14, and into the annular chamber 72, and passages 68 may also comprise one or more passages, such as jet passages 74, from the annular chamber 72, through the mandrel 14, and to the downhole facing end 70 of the mandrel 14. Jet passages 74 may terminate at downhole facing end 70 in jet nozzles (not shown). To reduce friction on fluid flow prior to entering passages 68, the stem 30 may be dimensioned such that inner wall 90 of stem 30 is flush with (as shown), or wider than, inner bore 18.

Using annular chamber 72 to communicate fluid between lateral passages 76 and jet passages 74 makes it easier to manufacture tool 10 because manufacturing difficulties associated with forming multi-axis continuous internal fluid passages, which may be otherwise required in mandrel 14 to pass fluid from inner bore 18 and around magnet 16, are obviated. As shown in FIG. 3, use of annular chamber 72 also allows stem 30 and receptacle 22 to be dimensioned narrower than magnet 16. Use of annular chamber 72 versus a mandrel 14 that wholly contains and defines fluid passages 68 also means that cap retainer 44 is allowed to be rotatably threaded into place within downhole facing open end 20 of top sub 12 without having to align jet passages 74 with corresponding fluid passages (not shown) internal to the mandrel 14.

Fluid passages 68 allow fluid to be circulated from the surface and into the well bore where the fluid is used to disturb and remove materials and other undesirable junk from the well. By agitating the material at the bottom of the well with fluid, magnetic and magnetically attractable material is more likely to be brought in sufficient proximity with magnet 16 to be pulled and held against magnet 16 for removal from the well. In addition, although junk is typically in the form of ferrous or metal objects attractable by magnet 16, such junk may also include metal objects not attractable by magnet and nonmetal objects. Such nonmagnetic materials, for example, sediment, may be removed by circulating into a junk basket (not shown) or by pumping fluid with entrained material up the annulus and out of the well. Fluid flow can also be reversed through tool 10, by flowing down the annulus and up the inner bore 18.

Figure 4:
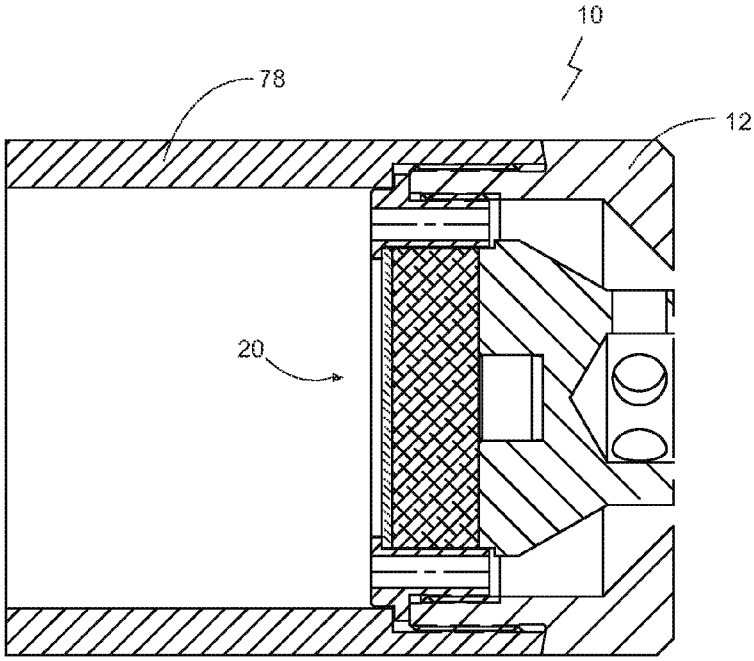
FIG. 4 is a side elevation view of a portion of a downhole magnet tool fitted with a mill guide.

Referring to FIG. 4, tool 10 may comprise a lower sub 78 that is open, hollow, and connected to the top sub 12 at the downhole facing open end 20. Lower sub 78 may comprise one or more of a mill guide 80 (shown in FIG. 4), a cut lip guide, and a flush guide 82 (FIG. 3). Lower sub 78 may in some cases be used for removing a core sample. During operations such as well cleaning, which is typically accomplished by washing, it may be desirable at the same time to obtain a geological sample core. Conventionally, sample cores may be obtained by running a core barrel, which is an elongated hollow barrel structure having a reamer or core shoe at the lower end. As the barrel is rotated, the reamer makes a circular cut through the formation about a sample core that is received inside of the barrel and is retracted as the core barrel is removed from the well. By using magnet tool 10 in combination with a lower sub 78 adapted for coring, it is possible to conduct washing operations at the same time as core samples are taken.

Figure 5:
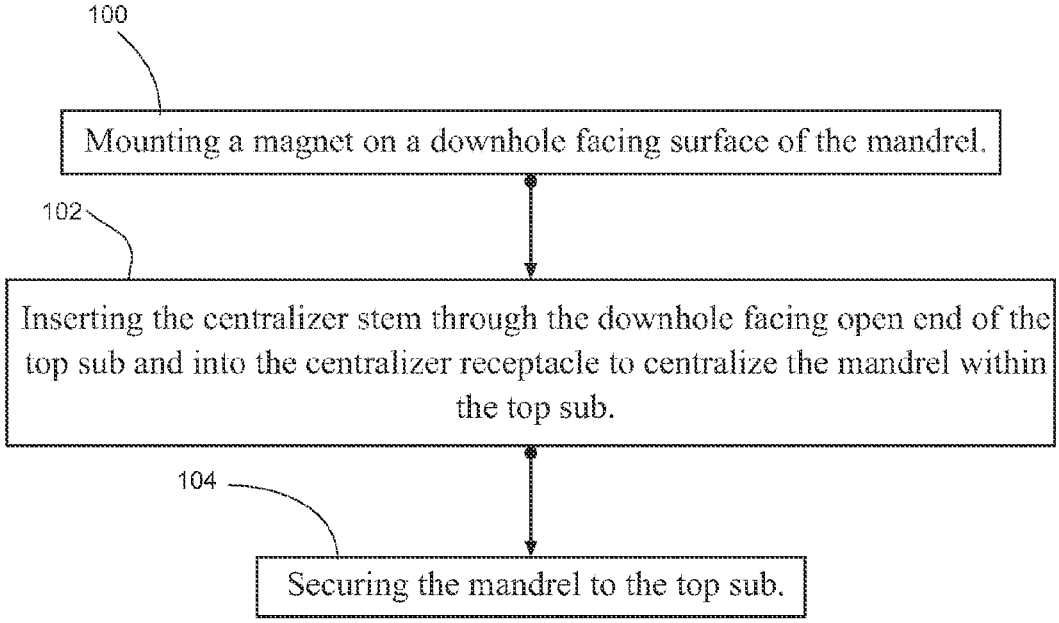
FIG. 5 is a flow diagram of a method of assembly of a downhole magnet tool.

Referring to FIG. 5, a method of assembly of a downhole magnet tool 10 is illustrated. Prior to and throughout assembly, nearby metal objects ought to be removed from the workplace for safety. The method stages will now be described with reference to FIGS. 1-3. In a stage 100 (shown in FIG. 5), a magnet 16 is mounted on a downhole facing surface 32 of the mandrel 14 (FIG. 1). Pin 42 may be used for this purpose to assist in positioning magnet 16 on downhole facing surface 32 of mandrel 14. Pin 42 is initially pressed into or attached within pocket 40. After magnet 16 is in place, cap retainer 44 may be slid over magnet 16 and cylindrical portion 54 of mandrel 14 to complete mandrel 14 and laterally lock magnet 16 to the mandrel 14.

Next, in stage 102 (shown in FIG. 5), the centralizer stem 30 is inserted through the downhole facing open end 20 of the top sub 12 and into the centralizer receptacle 22 to centralize the mandrel 14 within the top sub 12 (FIG. 1). Insertion may be accomplished in various ways, such as by retaining top sub 12 in a vice and allowing a user to manually insert mandrel 14. Depending on the weight of mandrel 14, a hoist (not shown) may be used to guide mandrel 14 into position. As shown in FIG. 1, the inserting stage 102 may include an intermediate stage where the centralizer stem 30 is inserted within the centralizer receptacle 22 a distance 97, such as half an inch or more depending on the design, sufficient to centralize the mandrel 14 within the top sub 12, while the magnet 16 is still spaced in a downhole direction from the downhole facing open end 20 of the top sub 12. Thus, the design of mandrel 14 may ensure that mandrel 14 is axially aligned before magnet 16 enters top sub 12.

FIG. 2 illustrates the next stage 104 where the mandrel 14 is secured to the top sub 12. Securing may be achieved as described above by rotating cap retainer 44 to couple threadings 48 and 50. FIG. 3 illustrates that a lower sub 78 such as flush guide 82 may then be secured to downhole open end 20. Lower sub 78 may further secure mandrel 14 within top sub 12, by use of an uphole facing annular shoulder 84, on lower sub 78, that is dimensioned to directly or indirectly abut a downhole facing surface 86 of mandrel 14. Welds (not shown) or other suitable techniques may be used at any point in the assembly of tool 10 to secure two or more components together. In some cases, stem 30 may thread to top sub 12.

The use of directional language such as up, down, above, below, uphole, and downhole in this document illustrate relative motions within tool 10, and are not intended to be limited to vertical motions and motions carried out while tool 10 is positioned downhole. Terms such as lateral or axial are relative to axis 88 (FIG. 1) of tool 10 or mandrel 14. It should be understood that tool 10 may be used in any type of well, including, for example, vertical, deviated, and horizontal wells.

Although described herein for the use of tubing, tool 10 may be adapted for wireline use. Tools 10 of the type disclosed herein may also be used in, for example, fishing, drilling, well-servicing, or other, operations. Although various components of the tool 10 are illustrated in the figures as having circular cross sections taken perpendicular to the tool axis 88 (FIG. 1), this need not be the case, and different cross-sectional shapes may be used to achieve the same purpose. For example, stem 30 need not be cylindrical in cross-section, but may be cross-shaped or rectangular. In addition, chamber 72 need not be annular, and may be defined by one or more non-annular chambers radially spaced about the tool axis. Widths discussed in this document may refer to diameters of components of circular cross-section.

Components of tool 10 may be composed of two or more sub-components. For example, top sub 12 may include two or more tubular pieces. Tool 10 may include more than one stem 30 and more than one corresponding receptacle 22.

In the claims, the word "comprising" is used in its inclusive sense and does not exclude other elements being present. The indefinite article "a" before a claim feature does not exclude more than one of the feature being present. Each one of the individual features described here may be used in one or more embodiments and is not, by virtue only of being described here, to be construed as essential to all embodiments as defined by the claims.

The embodiments of the invention in which an exclusive property or privilege is claimed are defined as follows:

1. A downhole magnet tool comprising:

a top sub having an inner bore terminating in a downhole facing open end, the inner bore defining a centralizer receptacle of smaller width than a width of the downhole facing open end;

a mandrel terminating upwardly in a centralizer stem, the centralizer stem being fitted in the centralizer receptacle of the top sub;

a magnet mounted on a downhole facing surface of the mandrel, the magnet being disc shaped; and a cap retainer securing the magnet, against relative axial movement, to the mandrel and the top sub;

in which a first distance from the downhole facing surface of the mandrel to a portion of the centralizer stem is longer than a second distance from the downhole facing open end to a downhole end of the centralizer receptacle.

2. The downhole magnet tool of claim 1 in which the mandrel comprises at least in part nonmagnetic material.

3. The downhole magnet tool of claim 1 in which the centralizer stem is shaped to fit telescopically within the centralizer receptacle of the inner bore.

4. The downhole magnet tool of claim 1 in which the first distance is at least one inch longer than the second distance.

5. The downhole magnet tool of claim 1 in which the magnet is positioned at least partially within the top sub in use.

6. The downhole magnet tool of claim 1 in which the inner bore terminates in an uphole facing open end and in which at least the mandrel defines one or more fluid passages between the inner bore and a downhole facing end of the mandrel.

7. The downhole magnet tool of claim 6 in which the one or more fluid passages comprise an annular chamber defined between the mandrel and the top sub.

8. The downhole magnet tool of claim 7 in which the one or more fluid passages comprise:

one or more passages from the inner bore, through the mandrel, and into the annular chamber; and one or more passages from the annular chamber, through the mandrel, and to the downhole facing end of the mandrel.

9. The downhole magnet tool of claim 1 in which the mandrel further comprises a magnet positioner at least partially embedded in a pocket in the downhole facing surface of the mandrel and being made at least in part of material that is attracted or attractable to the magnet.

10. The downhole magnet tool of claim 1 in which the mandrel comprises a protector plate covering a downhole facing surface of the magnet.

11. The downhole magnet tool of claim 1 further comprising a lower sub that is open, hollow, and connected to the top sub at the downhole facing open end.

12. The downhole magnet tool of claim 11 in which the lower sub is selected from the group consisting of a flush guide, a cut lip guide, and a mill guide.

13. The downhole magnet tool of claim 1 in which the magnet is a rare earth magnet.

14. The downhole magnet tool of claim 1 adapted for use with coiled or jointed tubing.

15. A method of assembly of a downhole magnet tool having a top sub, a mandrel, and a magnet, the top sub having an inner bore that terminates in a downhole facing open end and defines a centralizer receptacle of smaller width than the downhole facing open end, the mandrel terminating upwardly in a centralizer alignment stem, the method comprising:

mounting a magnet, on a downhole facing surface of the mandrel;

inserting the centralizer stem through the downhole facing open end of the top sub and into the centralizer receptacle to centralize the mandrel within the top sub, in which inserting includes an intermediate stage where the centralizer stem is inserted within the centralizer receptacle a distance sufficient to centralize the mandrel within the top sub, and the magnet is spaced in a downhole direction from the downhole facing open end of the top sub; and securing the magnet, against relative axial movement, to the mandrel and the top sub.

16. The method of claim 15 in which inserting further comprises a fully inserted stage where the magnet is positioned at least partially within the top sub.

* * * * *